US005765827A

United States Patent [19]

Gillmann

[11] Patent Number: 5,765,827

[45] Date of Patent: Jun. 16, 1998

[54] SORTING COMPARTMENT ARRANGEMENT FOR FLAT ITEMS

[75] Inventor: Hanno Gillmann, Konstanz, Germany

[73] Assignee: Licentia-Patent-Verwaltungs GmbH, Frankfurt, Germany

[21] Appl. No.: 650,518

[22] Filed: May 20, 1996

[30] Foreign Application Priority Data

May 19, 1995 [DE] Germany ..... 195 18 442.4

[51] Int. Cl.[6] ..... B65H 29/44

[52] U.S. Cl. ..... 271/300; 271/179; 271/220; 271/314; 271/305

[58] Field of Search ..... 271/179, 178, 271/220, 314, 299, 305, 300

[56] References Cited

U.S. PATENT DOCUMENTS

| | | | |
|---|---|---|---|
| 2,778,638 | 1/1957 | Whillock et al. | 271/179 |
| 4,019,730 | 4/1977 | Staudinger et al. | 271/181 |
| 4,509,739 | 4/1985 | Kurokawa | 271/179 |
| 4,657,241 | 4/1987 | Frank | 271/179 |
| 5,150,894 | 9/1992 | Ricciardi | 271/179 |
| 5,253,859 | 10/1993 | Ricciardi | 271/179 |

FOREIGN PATENT DOCUMENTS

| | | | |
|---|---|---|---|
| 0143818 | 4/1987 | European Pat. Off. . | |
| 2 561 632 A1 | 10/1984 | France . | |
| 85228 | 6/1957 | Netherlands | 271/86 |
| 6807471 | 12/1969 | Netherlands | 271/179 |
| 2 271 763 | 10/1992 | United Kingdom . | |

*Primary Examiner*—Karen B. Merritt
*Assistant Examiner*—Douglas Hess
*Attorney, Agent, or Firm*—Spencer & Frank

[57] ABSTRACT

A sorting compartment arrangement for flat items includes a conveying section for conveying the flat items successively in a vertical position. Switches are disposed along the conveying section. A plurality of individual stacking compartments are arranged one behind the other along the conveying section and associated with a respective one of the switches. The items are supplied by the switches to the individual stacking compartments. Each stacking compartment includes a stack wall up to which the items are transported, a stack roller and a guide plate for transporting and guiding, respectively, the items from the switch into the stacking compartment up to the stack wall to form a stack of items in the stacking compartment, and a mechanism for pressing the stack of items together until shortly before an arrival of a next item to be stacked.

5 Claims, 3 Drawing Sheets

SORTING COMPARTMENT ARRANGEMENT FOR FLAT ITEMS

CROSS-REFERENCE TO RELATED APPLICATIONS

This application claims the right of priority of German Application No. P 195 18 442.4 filed in Germany on May 19, 1995, the disclosure of which is incorporated herein by reference.

BACKGROUND OF THE INVENTION

The invention relates to a sorting compartment arrangement for flat items, such as letters arriving successively in a vertical position via a conveying section, having a plurality of stacking compartments arranged one behind the other to which the items are supplied via switches that are allocated separately to the individual compartments, and wherein the items are transported up to a stack wall via a guide plate and a stack roller such that a stack of items is formed.

Such a sorting compartment arrangement is shown in FIG. 1 and is used, for example, in automatic letter sorting installations, for a preliminary sorting by zip code areas of the letters arriving successively via a conveying section 100. The arrangement includes several stacking compartments 102 which are separately allocated to the zip code areas and arranged one behind the other. The items are allocated to the individual stacking compartments by switches 104 where the items are stacked. At the entrance to the compartment arrangement, a measuring section 105 is arranged in which the item is examined to determine whether it is too long or whether the gap between the successive items is too small. The gap must not fall short of a specific value since, otherwise, the switch does not have enough time to open or close in the gap. If items cannot be processed, or if the gap is too small, the items are stacked in a reject compartment (not shown).

European patent document EP-B 0143818, discloses an arrangement as discussed above in which flat items such as letters arrive successively in a vertical position via a belt conveyor section and are stacked automatically in individual sorting compartments. Just prior to being stacked, the items in their conveying path are provided with a stiffening bend along their longitudinal axis. The drawback of this known arrangement is that, during the stacking of items with transverse flaps or windows, these items may get caught on one another and might therefore not be transported up to the stack wall. This necessitates a manual alignment of the stacks of items before they are transported further.

SUMMARY OF THE INVENTION

It is therefore an object of the present invention to provide a sorting compartment arrangement wherein items with transverse flaps or windows can also be stacked perfectly.

The above and other objects are accomplished according to the invention by the provision of a sorting compartment arrangement for flat items, comprising: a conveying section for conveying the flat items successively in a vertical position; switches disposed along the conveying section; a plurality of individual stacking compartments arranged one behind the other along the conveying section and associated with a respective one of the switches, the items being supplied by the switches to the individual stacking compartments, each stacking compartment including: a stack wall up to which the items are transported; a stack roller and a guide plate for transporting and guiding, respectively, the items from the switch into the stacking compartment up to the stack wall to form a stack of items in the stacking compartment; and means for pressing the stack of items together until shortly before an arrival of a next item to be stacked.

In a particularly advantageous embodiment, the stack of items is pressed together by means of the stack roller and the stack roller is moved away from the stack of items shortly before the next item to be stacked arrives in the respective stacking compartment. The next item is thus transported along the guide plate and via the stack roller into the gap created between the stack of items and the stack roller. By the time the stack of items has opened up, the item to be stacked has been transported reliably up to the stack wall. It is also advantageous to drive the stack roller only during the stacking process to prevent items from suffering damage which can occur if, due to a great number of stacking compartments in the sorting arrangement, no new items are stacked in specific stacking compartment over a long period. A particularly simple and effective embodiment of the stacking compartment results if the stack roller is pressed against a moving conveying belt during the stacking process and is thus itself put into a rotating motion, and if, during the remainder of the time, the stack roller is decoupled from the conveying belt and presses the stack of items together. Should a stack spiral be necessary because of the items that need to be sorted, it is advantageous to drive the spiral from the stack roller, particularly via an O-ring, and especially if the stack roller is driven only during the stacking process. This prevents damage caused by the stack spiral if a new item does not reach the stacking compartment for a long time. It is particularly advantageous to embody the switch and the guide plate to have a concave shape. This means that a specialized device such as an additional bulge roller, as disclose in the above-mentioned EP-B 0143818, can be dispensed with. In this manner, the distance between the stacking point and the switch section can be reduced and can be employed to increase the stacking compartment capacity without impairing accessibility in case of malfunctions.

Finally, it is advantageous to arrange the guide plate with an aperture angle toward the stack wall so that the front edges of the items can fan out slightly and the stack pressure immediately in front of the stack wall is even slightly smaller.

The invention is explained below in greater detail by way of FIGS. 2 to 4 for an especially advantageous embodiment.

DETAILED DESCRIPTION OF THE PREFERRED EMBODIMENT

Figure 1:
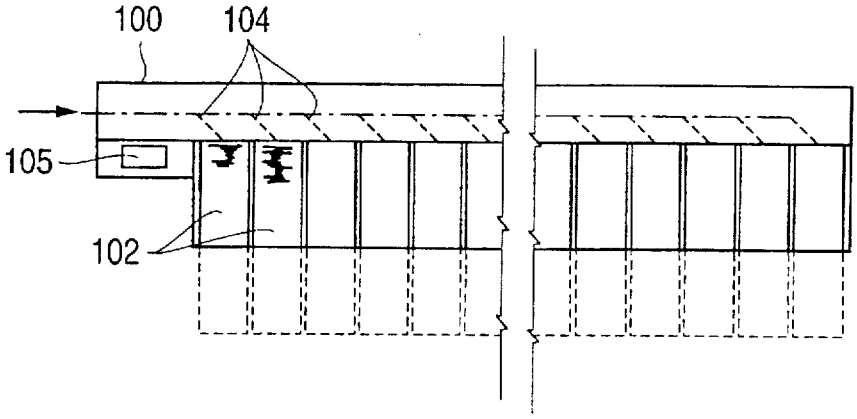
FIG. 1 (PRIOR ART)
FIG. 1 is a schematic showing a known sorting compartment arrangement.
Figure 4:
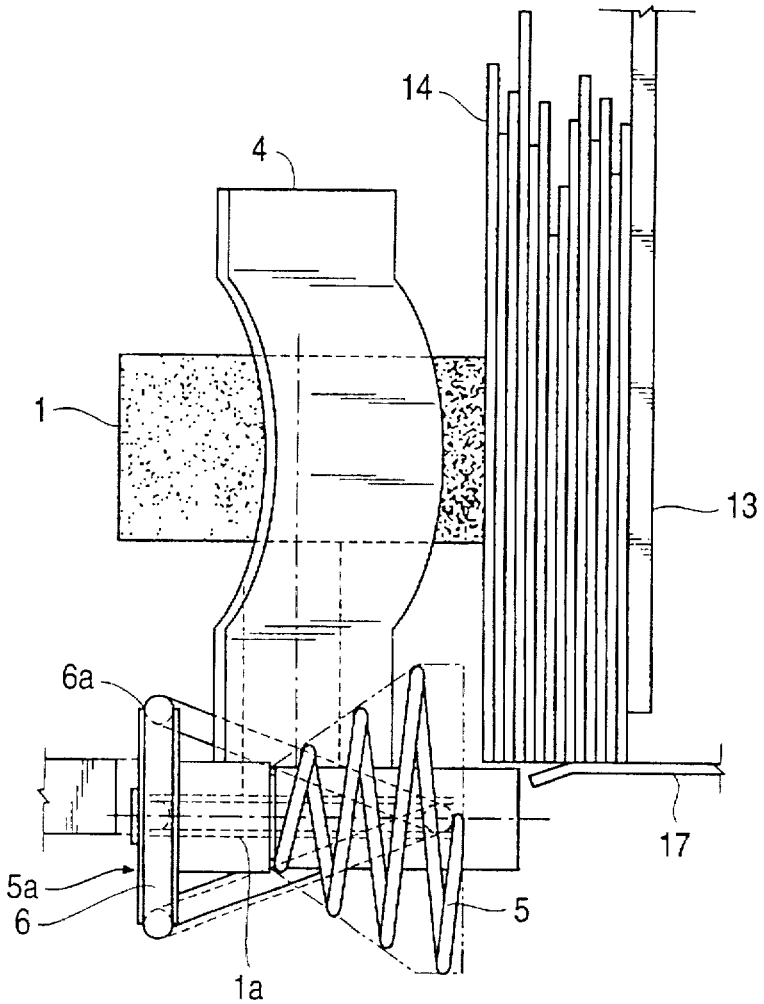
FIG. 4 is a sectional view taken along section A—A from FIG. 2.
Figure 2:
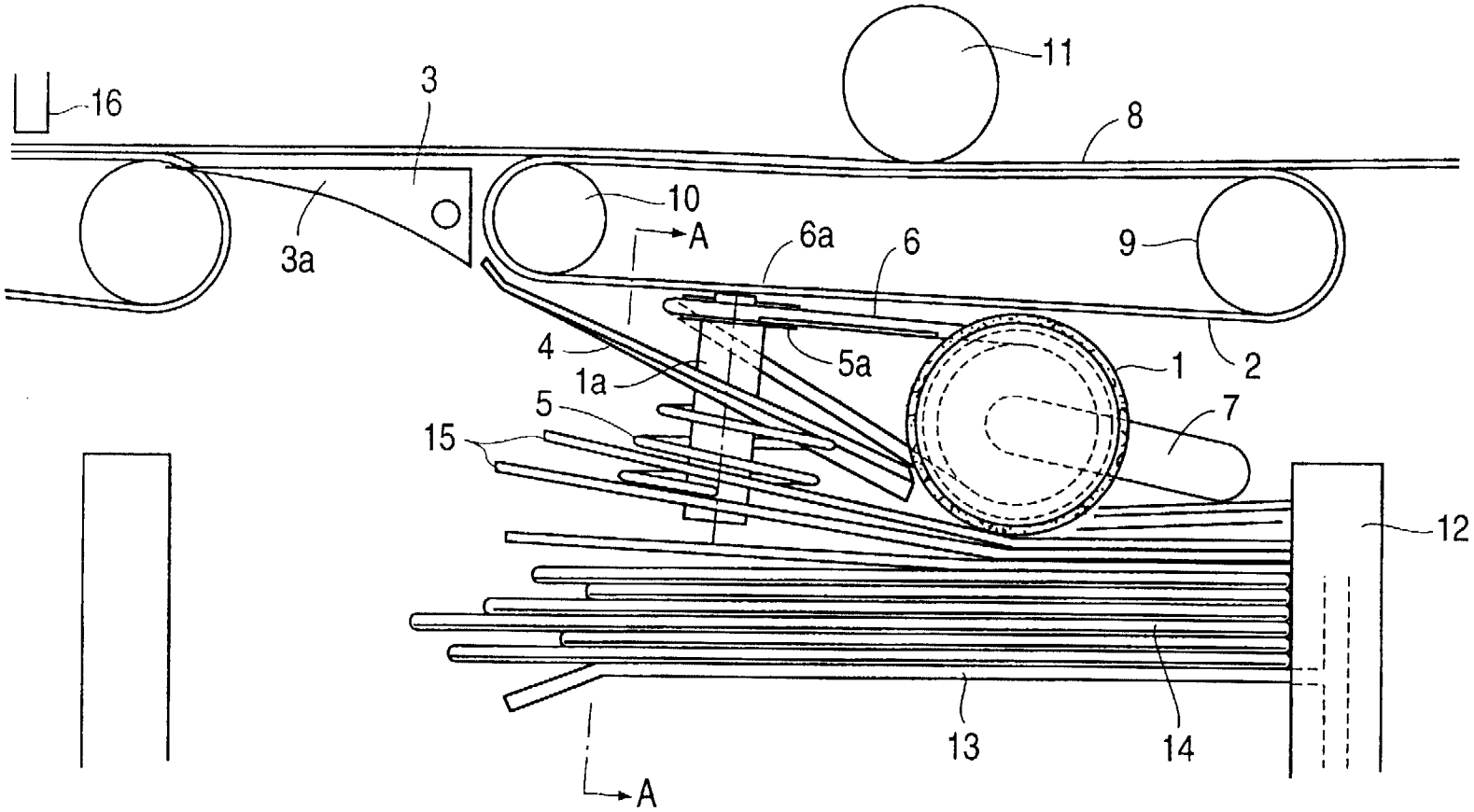
FIG. 2 is a top view of a stacking compartment arrangement in a rest position according to the invention.
Figure 3:
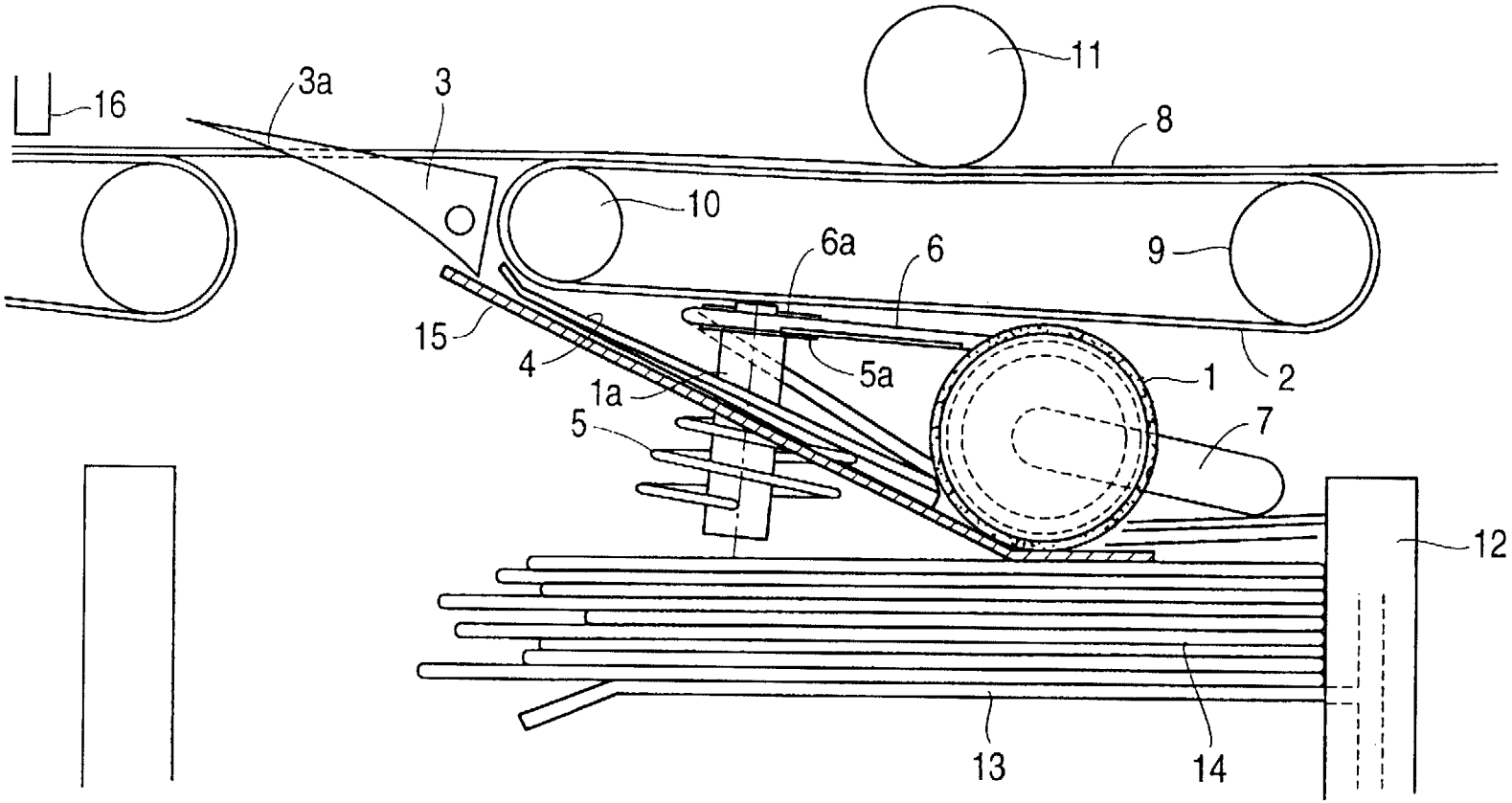
FIG. 3 is a top view of the stacking compartment arrangement from FIG. 2 in a stacking position.

Referring to FIGS. 2 to 4, items 15, such as letters, are transported in an upright or vertical position between conveying belts 2 and 8. Conveying belt 2 is driven, for example, by roller 9 and/or roller 10. Conveying belt 8 is only carried along. A wrap around roller 11 is just large enough so that a reliable transport of the item is ensured. A stack roller 1 is connected in a driving manner to an auxiliary roller 1*a*. Auxiliary roller 1*a* is connected with a disc 5*a* which is provided on it circumference with a groove 6*a* in which there is disposed an O-ring 6 that is wrapped around stack roller 1 for driving auxiliary roller 1*a*. Rotation of auxiliary roller 1*a* drives a stack spiral 5 connected to auxiliary roller 1*a*.

A switch 3 is preferably driven by a hinged armature magnet (not shown) and, on the side facing the stacking compartment, the switch segment has a concave shape. The axis of the stack roller 1 is secured to a lever 7. In the rest position, a spring (not shown), presses stack roller 1 against the stack of items 14. In this position, stack roller 1 does not rotate because it is not driven by conveyor belt 2. Thus, stack spiral 5 is also at a standstill (FIG. 2). Preferably a magnet (not shown) presses stack roller 1 in a stacking position against conveyor belt 2 and holds the stack roller in this position during the stacking process. A guide plate 4 is stationary and embodied so as to be convex between switch 3 and stack roller 1 to promote a longitudinal bulging of item 15 to be stacked. Guide plate 4 is provided with a cutout through which the stack roller 1 can plunge in both the stacking and the rest position. To the right of stack roller 1, guide plate 4 is not disposed perpendicularly with respect to the stack wall 12 but with an aperture angle so that the front edges of items 15 to be stacked can fan out slightly and the stack pressure immediately in front of a stack wall 12 up to which the items are transported is even slightly smaller.

Stacking occurs in the following manner. As soon as the front edge of an item 15 to be stacked in the respective stacking compartment has passed a light barrier 16 (FIG. 3), switch 3 is actuated. It is released again with a specific delay once the rear edge of item 15 to be stacked has passed the light barrier and it is thus ensured that the switch has been traversed. When the front edge of item 15 to be stacked has reached stack roller 1, stack roller 1 will have reached approximately the speed with which the items are transported between conveyor belts 2 and 8. A fold-over process of stack roller 1 is carried out accordingly. The rpm of stack spiral 5 then corresponds to the ratio of the diameters of groove 6*a* and of roller 1*a*. When the front edge of item 15 to be stacked has reached stack wall 12, stack roller 1 is separated from conveyor belt 2. Stack roller 1 then again presses against the stack of items 14 and the stack roller's speed is reduced down to a standstill by way of the friction against item 15. For specific types of items it may be advantageous to turn off the drive of the stack roller before item 15 touches the stack wall 12 so that less stress is placed on the front edge of item 15.

Stack spiral 5 is disposed in front of guide plate 4 between switch 3 and stack roller 1. Stack spiral 5 is configured such that it engages the lower edges of items 15 to be stacked during their passage and presses the longitudinal portions of items 15 to be stacked, which do not pass stack roller 1, against the stack of items 14. Stack spiral 5 can be dispensed with if only items are stacked whose longitudinal stiffness is so great that they rest against the stack of items 14, even if they are only pressed against it by stack roller 1. A stack support plate 13 is displaceable as a function of the thickness of the stack of items 14.

Advantageously, a compartment bottom 17 is on a slight incline with respect to the horizontal. This reduces the increase in the stack pressure as the stack increases so that the pressing or push-back effect of the decoupled stack roller 1 remains intact to a large extent.

If two or more items are successively sorted into the same compartment, the magnet (not shown) at switch 3 stays attracted. But stack roller 1 is respectively decoupled from conveyor belt 2 to press together the stack of items 14 at least partially. When dealing with shorter items, there may not be enough time to press together the stack of items 14 completely before coupling must take place again. But usually, shorter items such as postcards or items in the DIN-C6 format do not have transverse flaps or windows so that the desired function is not impaired in a meaningful way. The corresponding optimum switching times for switch 3 and stack roller 1 are a function of the dimensions of the sorting compartment arrangement, the individual stacking compartments, the speed of the items and the minimum distances between the items.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. A sorting compartment arrangement for flat items, comprising:

a conveying section for conveying the flat items successively in a vertical position;

switches disposed along the conveying section;

a guide plate disposed downstream of each switch;

a plurality of individual stacking compartments arranged one behind the other along the conveying section and associated with a respective one of the switches, the items being supplied by the switches to the individual stacking compartments via a respective one of the guide plates, each stacking compartment including a stack wall up to which the items are transported;

a lever;

a stack roller mounted on the lever for movement between a stacking position for transporting the items from the switch into the stacking compartment up to the stack wall to form a stack of items in the stacking compartment during a stacking operation, and a pressing position for pressing the stack of items together; and means for moving the stack roller away from the stack of items in the pressing position and into the stacking position shortly before an arrival of a next item to be stacked, wherein the next item is transported by the stack roller during the stacking operation into a corresponding gap created between the stack of items and the stack roller up to the stack wall.

2. The sorting compartment arrangement according to claim 1, further including means for rotatably driving the stack roller only during the stacking operation.

3. The sorting compartment arrangement according to claim 2, wherein the conveying section includes a circulating belt and the driving means includes means for urging the stack roller against the belt of the conveying section only during the stacking operation for rotatably driving the stack roller.

4. The sorting compartment arrangement according to claim 3, wherein the means for urging the stack roller against the belt of the conveying section during the stacking operation includes a magnet and the means for pressing the stack roller against the stack of items comprises a spring which biases the stack roller against the stack of items.

5. The sorting compartment arrangement according to claim 4, further comprising an auxiliary roller rigidly connected with the stack roller, an O-ring, and a stack spiral driven by the auxiliary roller via the O-ring.

* * * * *